US009333514B2

(12) United States Patent
Terholsen et al.

(10) Patent No.: US 9,333,514 B2
(45) Date of Patent: May 10, 2016

(54) FULLY JACKETED SCREW CENTRIFUGE HAVING AN OVERFLOW WEIR

(75) Inventors: Stefan Terholsen, Oelde (DE); Jürgen Hermeler, Sassenberg (DE); Ludger Horstkötter, Ennigerloh (DE); Kathrin Quiter, Drensteinfurt (DE); Jürgen Teigeler, Oelde (DE)

(73) Assignee: GEA Mechanical Equipment GmbH, Oelde (DE)

( * ) Notice: Subject to any disclaimer, the term of this patent is extended or adjusted under 35 U.S.C. 154(b) by 414 days.

(21) Appl. No.: 13/702,437

(22) PCT Filed: Jul. 25, 2011

(86) PCT No.: PCT/EP2011/062722

§ 371 (c)(1),
(2), (4) Date: Nov. 6, 2013

(87) PCT Pub. No.: WO2012/013624

PCT Pub. Date: Feb. 2, 2012

(65) Prior Publication Data

US 2014/0051565 A1 Feb. 20, 2014

(30) Foreign Application Priority Data

Jul. 28, 2010 (DE) ..... 10 2010 032 503

(51) Int. Cl.
*B04B 1/20* (2006.01)

(52) U.S. Cl.
CPC ..... *B04B 1/20* (2013.01); *B04B 2001/2075* (2013.01); *B04B 2001/2083* (2013.01)

(58) Field of Classification Search
CPC ..... B04B 1/20; B04B 2001/2075; B04B 2001/2083; B04B 11/00; B04B 11/02
USPC ..... 494/53, 57
See application file for complete search history.

(56) References Cited

U.S. PATENT DOCUMENTS

2004/0072668 A1 4/2004 Leung

FOREIGN PATENT DOCUMENTS

| | | | | | |
|---|---|---|---|---|---|
| DE | 3907151 | A1 | | 8/1990 | |
| DE | 102 03 652 | A1 | | 8/2003 | |
| JP | 11-179236 | A | | 7/1999 | |
| JP | 11-197547 | A | | 7/1999 | |
| JP | 11197547 | A | * | 7/1999 | ..... B04B 1/20 |
| WO | 2008/138345 | A1 | | 11/2008 | |
| WO | WO 2008138345 | A1 | * | 11/2008 | ..... B04B 1/20 |

* cited by examiner

*Primary Examiner* — Charles Cooley
*Assistant Examiner* — Shuyi S Liu
(74) *Attorney, Agent, or Firm* — Crowell & Moring LLP

(57) ABSTRACT

A solid-wall screw centrifuge includes a discharge for discharging a clarified liquid from a drum of the centrifuge. The drum includes a passage in a drum cover associated with a weir plate. The passage, drum cover, and weir plate form an overflow weir on a radial inner edge. A deflecting device is arranged on an outside on the drum cover, the deflecting device is arranged such that an exiting fluid flow from the centrifuge is one of deflected in the circumferential direction and subjected to a twist in the circumferential direction.

12 Claims, 2 Drawing Sheets

FULLY JACKETED SCREW CENTRIFUGE HAVING AN OVERFLOW WEIR

CROSS-REFERENCE TO RELATED APPLICATION

This application is a national stage of International Application PCT/EP2011/062722, filed Jul. 25, 2011, and claims benefit of and priority to German Patent Application No. 10 2010 032 503.1, filed Jul. 28, 2010, the content of which Applications are incorporated by reference herein.

BACKGROUND AND SUMMARY

The present disclosure relates to a solid-wall screw centrifuge including a discharge for discharging a clarified liquid from a drum of the centrifuge. The drum includes a passage in a drum cover associated with a weir plate. The passage, drum cover, and weir plate form an overflow weir on a radial inner edge. A deflecting device is arranged on an outside on the drum cover. The deflecting device is arranged such that an exiting fluid flow from the centrifuge is one of deflected in the circumferential direction and subjected to a twist in the circumferential direction.

Solid-wall screw centrifuges are known.

DE 102 03 652 B4 discloses a solid-wall screw centrifuge comprising a device for discharging clarified fluid from a drum having a drum cover with a passage. The passage associated with a throttle device, for example, an orifice gauge, the distance of which to the passage is variable. The passage is further associated with nozzles for the discharge of the clarified fluid, which nozzles are aligned obliquely in relation to the radial direction through the drum axis for saving energy.

Nozzles on solid-wall screw centrifuges and their effect of energy saving in a respective alignment obliquely in relation to the drum axis are further known from DE 39 04 151 A1.

The publication of "Patent Abstracts of Japan", No. 11179236A, discloses that guide plates can be associated with passage openings in the drum cover which are respectively partly sealed by a weir plate forming an overflow weir. The guide plates provide fluid exiting the drum with a twist, wherein the occurring repulsion effect is to be used for energy saving. The guide plates are attached to the outside of the overflow weir on the weir plates, for example. They are arranged as flat plates, for example, which are aligned parallel to the rotational axis of the drum. The plane in which the flat plates are disposed does not intersect the drum axis and encloses an angle of approximately 45° with the radially extending straight line which, respectively, extends through the rotational axis of the drum and the respective passage opening.

The present disclosure thus relates to embodiments that provide a solid-wall screw centrifuge which is optimized with respect to energy saving.

The present disclosure further relates to a solid-wall screw centrifuge that includes a discharge for discharging a clarified liquid from a drum of the centrifuge. The drum includes a passage in a drum cover associated with a weir plate, which passage, drum cover, and weir plate form an overflow weir on a radial inner edge. A deflecting device is arranged on an outside on the drum cover, the deflecting device being arranged such that an exiting fluid flow from the centrifuge is one of deflected in the circumferential direction and subjected to a twist in the circumferential direction. The deflecting device is arranged so as to maintain the position of the overflow weir such that the exiting fluid flow is deflected in the circumferential direction at an overflow edge of the weir flute and directly in an axial extension of a region of a passage opening that is not covered by the weir plate The deflecting device is, accordingly, arranged in such a way, for example, on the weir plate, that, by maintaining the overflow weir, an exiting fluid flow is subjected to a twist in the circumferential direction at the overflow edge in the axial extension of the passage opening.

This can be achieved, according to an embodiment of the present disclosure, in such a way, for example, that the deflecting wall is disposed partly directly in axial extension of the region of the passage opening not covered by the respective weir plate axially outside before the passage opening, and axially partly or fully covers the opening.

It is also known, for example, from U.S. 2004/0072668 A1 or WO 2008/138345 A1,to arrange a housing instead of an overflow weir on the weir plate of the passage opening, with the overflow weir or a nozzle being then arranged in an oblique side of the housing on the passage opening. These constructions are disadvantageous, however, in that co-rotating fluid chambers are formed on the outside of the drum cover, which fluid chambers form a part of the rotating system, so that the clarification or separation process can still continue in the fluid chambers. This separation process may lead to undesirable deposits in the chambers which lead to cleaning problems.

It is, therefore, advantageous that an embodiment according to the present disclosure leaves the overflow weir directly on the weir plates on the drum cover, and only the fluid which has already left the rotating system via the overflow weir will be deflected in the circumferential direction. After the exit from the drum, no clarification effect can occur any more. Instead, the entire exiting fluid jet will rather be deflected by the deflecting device in the circumferential direction.

Advantageous embodiments of the present disclosure are discussed herein and in the appended claims.

Other aspects of the present disclosure will become apparent from the following descriptions when considered in conjunction with the accompanying drawings.

DETAILED DESCRIPTION

Figure 2:
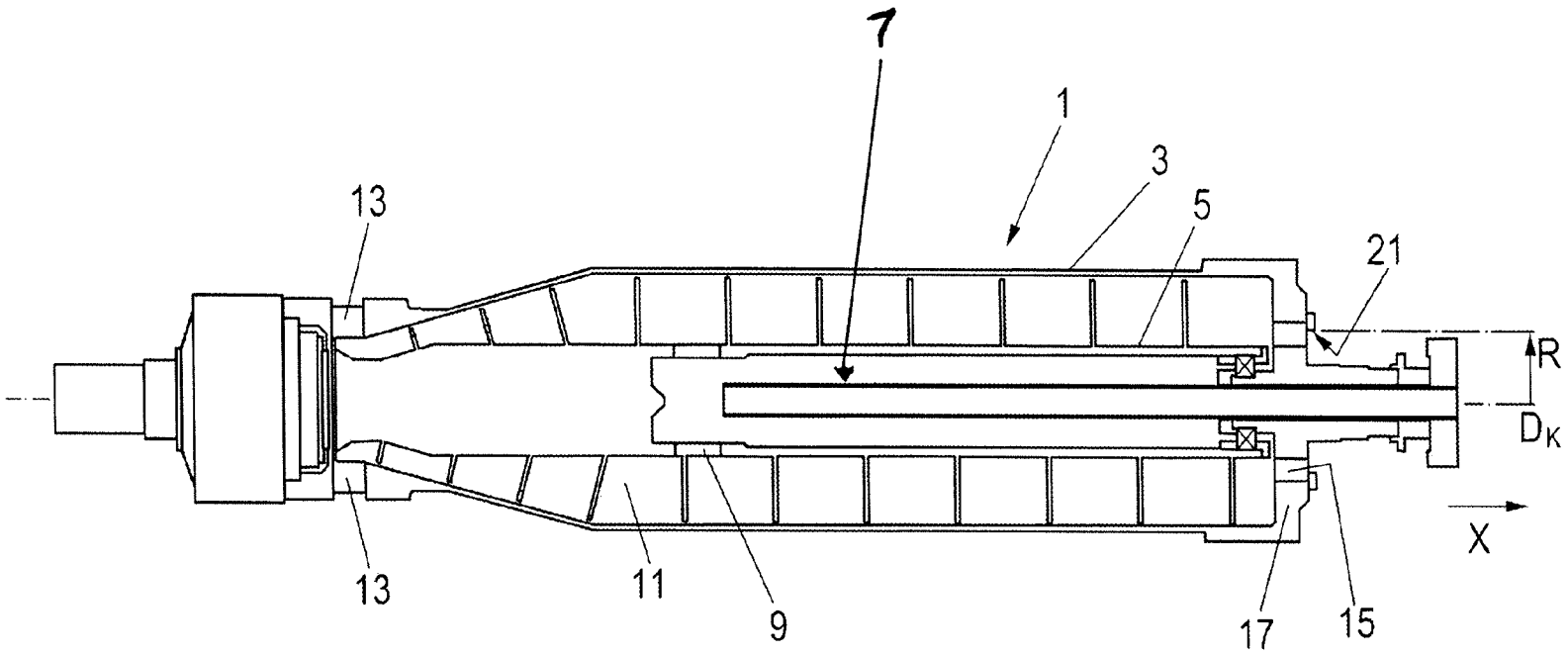
Fig. 2 PRIOR ART
FIG. 2 shows a schematic view of a known solid-wall screw centrifuge.

FIG. 2 illustrates the principal configuration of a solid-wall screw centrifuge. The drive and the control unit, a hood and further elements, which are obvious to the person skilled in the art, are not shown.

FIG. 2 shows a solid-wall screw centrifuge 1 with a drum 3 which is rotatable about a rotational axis D and in which a similarly rotatable screw 5 is arranged. The drum 3 and the screw 5, respectively, comprise a substantially cylindrical section and a conically tapering section.

An axially extending centric inlet tube 7 is used for feeding the material for centrifuging via a distributor 9 into the bowl 11 between the screw 5 and the drum 3.

When a sludgy mash is guided into the centrifuge 1, for example, larger solid particles will deposit on the drum wall. A fluid phase will form further to the inside.

The screw 5 will rotate with a slightly lower or higher speed than the drum 3 and will convey the ejected solid material towards the conical section from the drum 3 to the solid outlet 13. The fluid, on the other hand, flows towards the larger drum diameter at the rear end of the cylindrical section of drum 3 and is discharged their via a weir including passage openings 15 in a drum cover 17. Each passage opening 15 is associated with a weir plate 19 which is radially adjustably attached to the outside of the drum cover 17. The inner radial edge of the weir plate 19, therefore, defines an overflow edge and is, therefore, also the actual weir or overflow weir 21.

Figure 1:
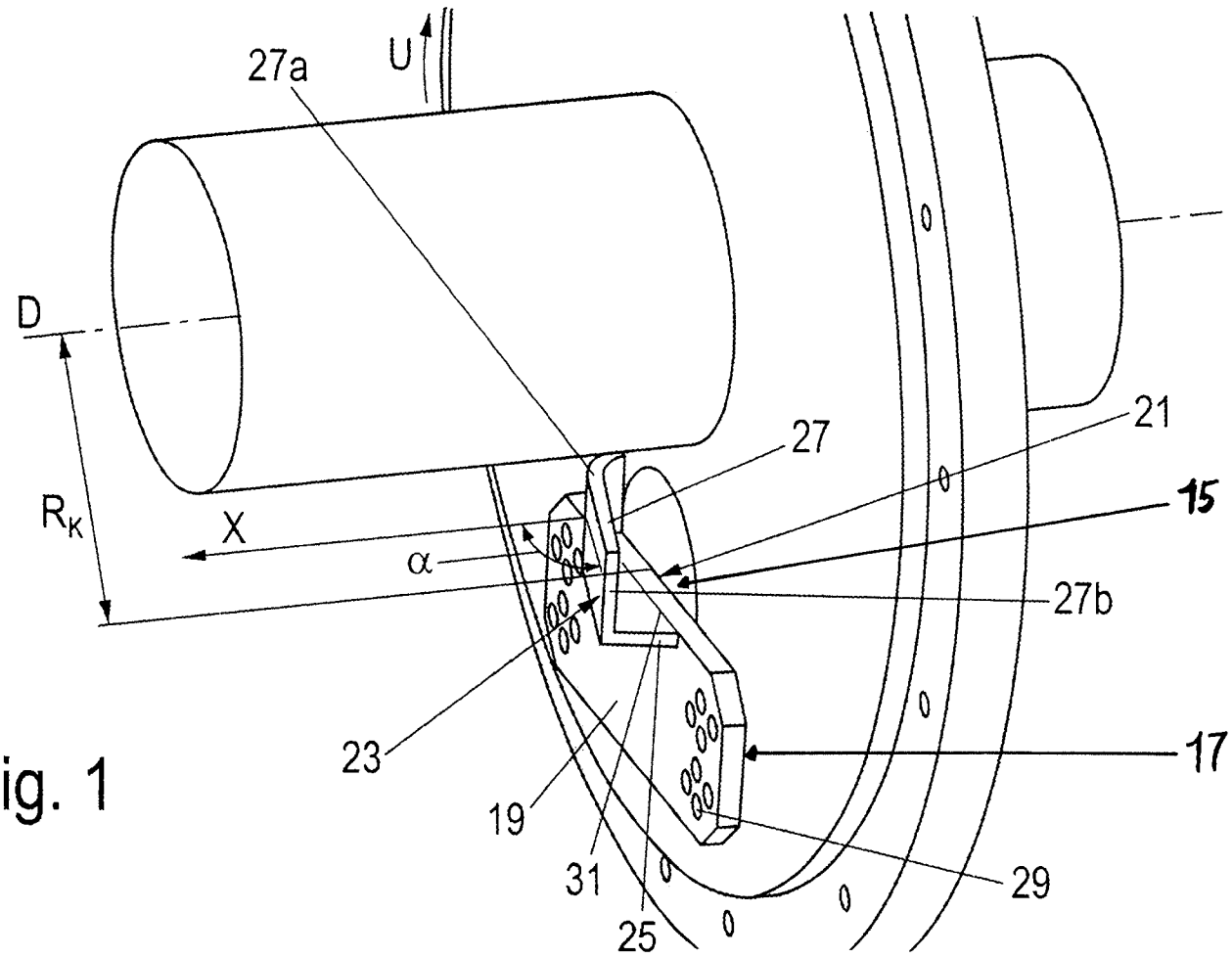
FIG. 1 shows a schematically illustrated drum cover of a solid-wall screw centrifuge, in accordance with the present disclosure.

In accordance with the embodiment of the present disclosure, the drum cover 17 or the at least one weir plate 21 on the drum cover 17 can be replaced by the drum cover 17 or the weir plate 21 of FIG. 1 in a solid-wall screw centrifuge of the kind according to the embodiment of the present disclosure shown in FIG. 2.

In accordance with FIG. 1, the drum cover 17 also comprises passage openings 15, which are respectively associated with a weir plate 19. The weir plates 19 are, for example, disposed directly outside on the drum cover 17, in parallel alignment on the cover 17.

The weir plates 19, respectively, form an overflow edge, and thereby an overflow weir 21, on their radius $R_K$ which is on the inside relative to the rotational axis D.

A deflecting device 23 may, in accordance with the present disclosure, be arranged on the outside on each of the weir plates 19. The deflecting device 23 may, in accordance with the present disclosure, include a support wall 25 extending parallel to the weir plate 19, as an axial wall section, and a deflecting wall 27 which is aligned at a right angle thereto. The axial wall section can, in accordance with the present disclosure, be flat or provided with a round configuration. The connecting line between the support wall 25 and the weir plate 19 is identified with a reference numeral 31.

The support wall 25 may, in accordance with the present disclosure, be in alignment with the overflow edge on the radius $R_K$ of the weir plate 19. It is advantageously achieved, in accordance with the present disclosure, that the actual weir 21 is not changed with respect to its position. It is still formed by the inside edge or overflow edge $R_K$ of the weir plates 19. This leads to the advantage that the advantageous properties of such an overflow weir 21 on a weir plate 19, in accordance with the present disclosure, are maintained.

It is within the scope of the present disclosure, that the support wall 25 is offset slightly radially to the outside relative to the support wall 25, so that the connecting line 31 extends radially slightly to the outside, for example, 0.5 mm to 3 mm further to the outside.

The deflecting wall 27, on the other hand, produces the actual deflection of the exiting product flow or the application of a twist in the circumferential direction, but does not change the position of the weir or overflow edge. The deflecting wall 27 merely ensures that the fluid which has flown over the overflow weir 21 is deflected from the axial direction. A deflection of the fluid jet is thereby substantially achieved in the circumferential direction, thus collectively resulting in saving energy as compared with a fluid outlet in the axial direction.

In order to achieve this, it is advantageous and in accordance with the present disclosure, if the deflecting wall comprises an arc-shaped wall section 27*a* and an adjacent flat wall section 27*b*.

The arc-shaped wall section 27*a* causes a deflection of the fluid phase flowing in the axial direction X from the drum 3 into the circumferential direction, or the application of a twist in the circumferential direction, against the rotational direction. The flat wall section 27*b* continues to guide the product flow to some extent in this direction. In accordance with the present disclosure, the arc-shaped section 27*a* is dimensioned in such a way that the deflection of the product flow from the axial direction X against the rotational direction U occurs substantially here, so that a repulsion effect is produced which leads to saving energy or energy recuperation.

The chosen deflection angle a, which corresponds to the alignment of the planar wall section relative to the axial direction, may be, in accordance with the present disclosure, for example, smaller than 90°; or, the deflection angle a may be, in accordance with the present disclosure, approximately 70 to 85°. By providing the deflection angle a with an angle which may be, for example, less than 90°, it is ensured in a simple way that an excessive amount of fluid flowing out of or exiting from the drum 3 will not be deflected too far out of the axial direction so that fluid will splash against the outside of the drum cover 17, which again would lead to certain energy losses.

It is advantageous, according to the present disclosure, that the deflecting wall 27 is disposed at least directly in the axial extension outside before the passage opening 15 and fully or partly covers the opening 15 axially on the radius of the passage opening 15.

As a result, an advantage, in accordance with the present disclosure, is achieved over the generic JP 11-179236, in that a larger fraction of the outflowing fluid is deflected already on the smaller radius of the passage opening 15 in the circumferential direction, so that higher amount of energy saving is achieved than disclosed in this JP specification, according to which specification the deflection always occurs on the larger radius. On the other hand, the embodiment of the present disclosure ensures that the radial position of the actual weir will not change, but will still be defined by the edge of the weir plates 19.

It is in accordance with the present disclosure, advantageous when the weir plate 19 and the deflecting device 23 are materially connected with one another and thereby form a constructional unit.

In accordance with the present disclosure, the weir plates 19 and the deflecting device 23 attached thereto are jointly radially adjustable, for example, by screws (not shown) with which the weir plates 19 can respectively be screwed onto the drum cover 17. Several screw bores 29 are distributed in a radially offset way on the weir plates 19, so that, by suitably choosing the screw bores 29, the radial position of the weir plates 19 on the drum cover 17 is easily adjustable.

It is advantageous that the construction, in accordance with the present disclosure, can be cleaned easily. By maintaining the position of the overflow weir 21, it is prevented that a space is formed in which dirt can easily accumulate.

Although the present disclosure has been described and illustrated in detail, it is to be clearly understood that this is done by way of illustration and example only and is not to be taken by way of limitation. The scope of the present disclosure is to be limited only by the terms of the appended claims.

We claim:

1. A solid-wall screw centrifuge comprising:

a discharge for discharging a clarified liquid from a drum of the centrifuge;

the drum including a passage in a drum cover associated with a weir plate, which passage, drum cover, and weir plate form an overflow weir on a radial inner edge of said weir plate; and a deflecting device arranged outside of the drum cover, the deflecting device arranged such that an exiting fluid flow from the centrifuge is one of deflected in a circumferential direction and subjected to a twist in the circumferential direction;

wherein the deflecting device is arranged on the weir plate such that a position of the overflow weir is maintained, and the exiting fluid flow is discharged from said passage past the overflow weir directly in an axial extension of a region of a passage opening that is not covered by the weir plate and then deflected in the circumferential direction by said deflecting device.

2. The solid-wall screw centrifuge according to claim 1, wherein the deflecting device is disposed directly in the axial extension outside of the passage opening and axially at least partly covers the passage opening.

3. The solid-wall screw centrifuge according to claim 1, wherein the deflecting device is attached to the weir plate.

4. The solid-wall screw centrifuge according to claim 1, wherein the at least one deflecting device includes a support wall and a deflecting wall which is aligned angularly in relation to the support wall.

5. The solid-wall screw centrifuge according to claim 4, wherein the support wall is arranged as an axial wall section, and the deflecting wall is arranged at a right angle to the support wall.

6. The solid-wall screw centrifuge according to claim 4, wherein the support wall is in alignment with the radially inner edge of the weir plate forming the overflow weir.

7. The solid-wall screw centrifuge according to claim 4, wherein the deflecting wall includes an arc-shaped wall section.

8. The solid-wall screw centrifuge according to claim 7, wherein the deflecting wall further includes a flat wall section adjacent to the arc-shaped wall section.

9. The solid-wall screw centrifuge according to claim 8, wherein the arc-shaped section is arranged in such a way that it produces a deflection of the clarified liquid flowing in an axial direction from the drum substantially into the circumferential direction.

10. The solid-wall screw centrifuge according to claim 8, wherein the arc-shaped section is dimensioned in such a way that a deflection of the exiting fluid flow occurs from an axial direction against a rotational direction about a deflecting angle which is smaller than 90°.

11. The solid-wall screw centrifuge according to claim 8, wherein the arc-shaped section is dimensioned in such a way that a deflection of the exiting fluid flow occurs from an axial direction against a rotational direction about a deflecting angle which is equal to 90°.

12. The solid-wall screw centrifuge according to claim 10, wherein the arc-shaped section is dimensioned in such a way that a deflection of the exiting fluid flow occurs from an axial direction against a rotational direction about a deflecting angle which is equal to 70-85°.

* * * * *